US008926072B2

(12) United States Patent
Balala et al.

(10) Patent No.: US 8,926,072 B2
(45) Date of Patent: Jan. 6, 2015

(54) PRINTER HAVING INK DELIVERY SYSTEM WITH AIR COMPLIANCE CHAMBER

(71) Applicant: Zamtec Limited, Dublin (IE)

(72) Inventors: Rommel Balala, North Ryde (AU); Robert Brice, North Ryde (AU); Kianoush Mir Sanaei, North Ryde (AU)

(73) Assignee: Memjet Technology Ltd., Dublin (IE)

( * ) Notice: Subject to any disclaimer, the term of this patent is extended or adjusted under 35 U.S.C. 154(b) by 0 days.

(21) Appl. No.: 13/931,240

(22) Filed: Jun. 28, 2013

(65) Prior Publication Data

US 2014/0009538 A1 Jan. 9, 2014

Related U.S. Application Data

(60) Provisional application No. 61/669,410, filed on Jul. 9, 2012.

(51) Int. Cl.
*B41J 2/175* (2006.01)
*B41J 2/19* (2006.01)

(52) U.S. Cl.
CPC ..... *B41J 2/175* (2013.01)
USPC ..... 347/85; 347/89

(58) Field of Classification Search
USPC ..... 347/84, 85, 86, 87, 89, 90, 92
See application file for complete search history.

(56) References Cited

U.S. PATENT DOCUMENTS 4,149,172 A * 4/1979 Heinzl et al. ..... 347/92
5,047,790 A * 9/1991 Cowger et al. ..... 347/87
5,216,450 A 6/1993 Koitabashi et al.
5,975,686 A 11/1999 Hauck et al.
6,007,193 A * 12/1999 Kashimura et al. ..... 347/92
6,481,837 B1 * 11/2002 Askren et al. ..... 347/85
7,014,303 B2 * 3/2006 Matsushita et al. ..... 347/85
7,431,443 B2 10/2008 Silverbrook et al.
7,448,739 B2 11/2008 Hibbard et al.
7,651,184 B2 * 1/2010 Nakamura et al. ..... 347/6
7,703,900 B2 4/2010 Morgan et al.
7,887,148 B2 * 2/2011 Esdaile-Watts et al. ..... 347/6
8,066,359 B2 11/2011 Silverbrook et al.
2008/0136849 A1 6/2008 Kaneko
2008/0204506 A1 8/2008 Nakamura et al.
2009/0219368 A1 9/2009 Esdaile-Watts et al.
2011/0025762 A1 2/2011 Rosati et al.
2011/0279566 A1 11/2011 Borra et al.
2012/0140006 A1 6/2012 Yunoki et al.

FOREIGN PATENT DOCUMENTS

EP 2030793 3/2009

OTHER PUBLICATIONS

International Search Report and Written Opinion issued for PCT/EP2013/064086 on Oct. 7, 2013, 11 pages.

* cited by examiner

*Primary Examiner* — Anh T. N. Vo
(74) *Attorney, Agent, or Firm* — Cooley LLP

(57) ABSTRACT

An inkjet printer includes: an inkjet printhead; an ink delivery system configured for supplying ink to the printhead at a negative hydrostatic pressure; and an air chamber in fluid communication with the ink delivery system. The air chamber has an air-permeable wall which is impervious to the ink. The air chamber provides dampening of pressure fluctuations in the ink delivery system and, further, is self-recovering from ingress of ink into the air chamber.

14 Claims, 5 Drawing Sheets

PRINTER HAVING INK DELIVERY SYSTEM WITH AIR COMPLIANCE CHAMBER

FIELD OF THE INVENTION

This invention relates to an ink delivery system for an inkjet printer. It has been developed primarily for minimizing pressure fluctuations in the ink delivery system, especially during pumping of ink.

BACKGROUND OF THE INVENTION

Inkjet printers employing Memjet® technology are commercially available for a number of different printing formats, including home-and-office ("SOHO") printers, label printers and wideformat printers. Memjet® printers typically comprise one or more stationary inkjet printheads, which are user-replaceable. For example, a SOHO printer comprises a single user-replaceable multi-colored printhead, a high-speed label printer comprises a plurality of user-replaceable monochrome printheads aligned along a media feed direction, and a wideformat printer comprises a plurality of user-replaceable multi-colored printheads in a staggered overlapping arrangement so as to span across a wideformat pagewidth.

Providing users with the ability to replace printheads is key advantage of the Memjet® technology. However, this places demands on the ink delivery system supplying ink to the printhead(s). For example, the ink delivery system should allow expired printheads to be de-primed before replacement so as not to cause inadvertent ink spillages and allow new printheads to be primed with ink after installation. Priming and de-priming operations generally require a pump to be incorporated into the ink delivery system.

A number of approaches towards ink delivery systems for inkjet printheads have been described in US2011/0025762; US2011/0279566; and US2011/0279562 (all assigned to the present Applicant), the contents of which are incorporated herein by reference.

The ink delivery systems described previously in connection with Memjet® printers generally comprise a closed loop system having first and second ink conduits interconnecting an ink container with respective first and second ink ports of the printhead. A reversible pump is positioned in the second ink conduit for pumping ink around the closed loop. Typically, a pinch valve is positioned on the first ink conduit for controlling the flow of ink or air through the printhead. As described in US2011/0279566 and US2011/0279562, the pump and pinch valve are coordinated to provide a multitude of priming, de-priming and other maintenance or recovery operations.

US2009/0219368 describes a printer comprising a pump and an air compliance chamber for dampening pressure fluctuations in a circulating ink delivery system. However, the air compliance chamber suffers from poor performance, because it can easily become filled with ink, for example, during transport or when the printer is tilted.

It would be desirable to provide a printer having an ink delivery system, which can dampen pressure fluctuations, such as those caused by actuation of a peristaltic pump, over the lifetime of the printer.

SUMMARY OF THE INVENTION

The present invention provides an inkjet printer comprising:

an inkjet printhead;

an ink delivery system configured for supplying ink to the printhead at a negative hydrostatic pressure; and an air chamber in fluid communication with the ink delivery system, wherein the air chamber comprises at least one air-permeable wall.

The printer according to the present invention advantageously provides pressure-dampening in the ink delivery system by means of the air chamber in fluidic communication therewith. Moreover, the air chamber providing compliance in the ink delivery system is self-recovering, ensuring that pressure-dampening is maintained over the lifetime of the printer. Hitherto, pressure-dampening air chambers, such as those described in US2009/0219368, were prone to filling with ink during transportation or when the printer is tilted. Although the air chamber in the present invention is similarly prone to filling with ink, the air-permeable wall in combination with the negative hydrostatic pressure in the ink delivery system ensures that the air chamber can readily recover to a state in which it is filled with air, and, significantly, without requiring any external intervention in order to recover.

The rate at which the air chamber recovers is, of course, dependent on parameters, such as permeability of the air-permeable wall, the length of the wall, the volume of the air chamber, the amount of negative ink pressure etc. Typically, these parameters are selected to provide full recovery within a period of about 10 hours to several days or weeks. A relatively slow recovery is acceptable, because inkjet printers spend most of their lifetime in an idle state, allowing ample periods for recovery. Moreover, ink filling the air compliance chamber is usually not a catastrophic event, and a relatively slow recovery towards optimum performance of the ink delivery system is acceptable in most circumstances.

Conventionally, air compliance chambers in ink delivery systems are configured to be impervious to air. It is counter-intuitive to employ air-permeable walls in an air compliance chamber, because the air must be able to compress against the walls of the chamber in order to absorb pressure spikes. However, a small degree of air-permeability strikes an acceptable balance between absorption of pressure spikes and self-recovery. Of course, the air-permeable wall should be impervious to ink to avoid leakage.

The skilled person will appreciate that certain polymers are air-permeable and, therefore, suitable for use in the present invention. For example, most silicones have a relatively high air-permeability and are used ubiquitously in contact lenses in light of this characteristic. For the purposes of the present invention, polymers having a relatively low air-permeability (i.e. less than that of conventional silicones) are generally most suitable.

Preferably, the air-permeable wall has an oxygen permeability of less than 100 Barrer ($334.8\times10^{-19}$ kmol m/($m^2$ s Pa)). The unit of "Barrer" is the standard unit of oxygen permeability used in the contact lens industry. [1 Barrer=$10^{-10}$ ($cm^3$ $O_2$) $cm^2$ $cm^{-3}$ $s^{-1}$ $cmHg^{-1}$].

Preferably, the air-permeable wall has an oxygen permeability in the range of 1 to 100 Barrer, preferably 5 to 50 Barrer, or preferably 7 to 30 Barrer.

Preferably, polymer tubing defines sidewalls of the air chamber, the polymer tubing being air-permeable. The polymer tubing may have a wall thickness in the range of 1 to 2 mm, and an internal diameter in the range of 2 to 5 mm. One type of tubing material suitable for use as the sidewalls of the air chamber is Tygoprene® XL-60, which is a thermoplastic elastomer available from Saint-Gobain Performance Plastics. However, it will be appreciated that other air-permeable materials are equally suitable for use in the present invention.

Preferably, the polymer tubing is connected to an ink conduit of the ink delivery system and extends generally upwards therefrom, the polymer tubing being capped to define the air chamber. Extending the tubing upwards from the ink conduit minimizes the propensity for ink to ingress into the air chamber (e.g. by tilting the printer).

The optimal volume of the air chamber is dependent on the frequency and amplitude of pressure spikes that are required to be dampened. Typically, the air chamber has a volume in the range of 0.1 to 2 $cm^3$, although it will be appreciated that the optimum volume will vary for different printers and ink delivery systems.

Preferably, the air chamber is positioned above a height of the printhead. By positioning, the air chamber above the printhead, the air chamber additionally functions as a bubble trap for any air bubbles present in the ink delivery system. The buoyancy of air bubbles in ink means that they will tend to accumulate at a highest point in the ink delivery system. Of course, any accumulation of air bubbles in the air chamber further aids recovery.

Preferably, the ink delivery system comprises a pump, such as a peristaltic pump. The air chamber is employed primarily for dampening pressure fluctuations associated with actuation of the pump.

Preferably, the air chamber is in fluid communication with an ink conduit interconnecting the printhead and the pump. By positioning the air chamber between the printhead and the pump (typically as close to the printhead as possible), the air chamber has a maximum dampening effect in respect of ink pressure spikes in the printhead.

Preferably, the printer comprises a pressure-regulating system for controlling the hydrostatic pressure in the ink delivery system. Inkjet printheads are usually supplied with ink at a negative hydrostatic pressure and, to that end, typically incorporate a pressure-regulating system for achieving negative pressures. A plethora of pressure regulators are known in the inkjet printing art, for example, diaphragm valve regulators (see U.S. Pat. No. 7,431,443), bubble-point regulators (see U.S. Pat. No. 7,703,900), spring regulators (see U.S. Pat. No. 7,448,739), air bellow regulators (see U.S. Pat. No. 5,975,686), capillary foam regulators (U.S. Pat. No. 5,216,450), gravity-feed regulators (see U.S. Pat. No. 8,066,359) etc. It will be appreciated that the present invention is not limited to any particular type of pressure regulator or any particular means for achieving a negative hydrostatic pressure in the ink delivery system.

Preferably, the ink delivery system comprises:

an ink container positioned below a height of the printhead, the ink container comprising an air vent open to atmosphere and a supply port;

a first conduit interconnecting the supply port and a first port of the printhead, wherein ink is gravity-fed to the printhead at negative hydrostatic pressure.

Preferably, the printer comprises:

a valve for controlling a flow of ink in the first conduit; and a controller for controlling opening and closing of the valve, wherein the controller is configured to open the valve when the printer is idle, such that the ink delivery system is at a negative hydrostatic pressure during idle periods, thereby allowing recovery of the air chamber via diffusion of air through the air-permeable wall.

Exposing the ink delivery system to negative hydrostatic pressures during idle periods advantageously maximizes the rate of recovery of the air chamber.

Preferably, the ink delivery system further comprises:

a second ink conduit interconnecting a second port of the printhead and a return port of the ink container; and a pump positioned in the second ink conduit.

Preferably, the air chamber is connected to the second ink conduit between the pump and the printhead. Preferably, the pump is a reversible peristaltic pump.

Preferably, the printer comprises an ink reservoir in fluid communication with the ink container.

Preferably, a regulator valve is configured to control a flow of ink into the ink container from the ink reservoir, so as to maintain a constant level of ink in the ink container.

More generally, the present invention provides a self-recovering pressure-dampened fluidic system comprising:

a liquid supply system configured to supply a liquid at a negative hydrostatic pressure; and an air chamber in fluid communication with the liquid supply system, wherein the air chamber comprises at least one air-permeable wall, which is impervious to the liquid.

BRIEF DESCRIPTION OF THE DRAWINGS

Embodiments of the present invention will now be described by way of example only with reference to the accompanying drawings, in which.

DETAILED DESCRIPTION OF THE INVENTION

Figure 1:
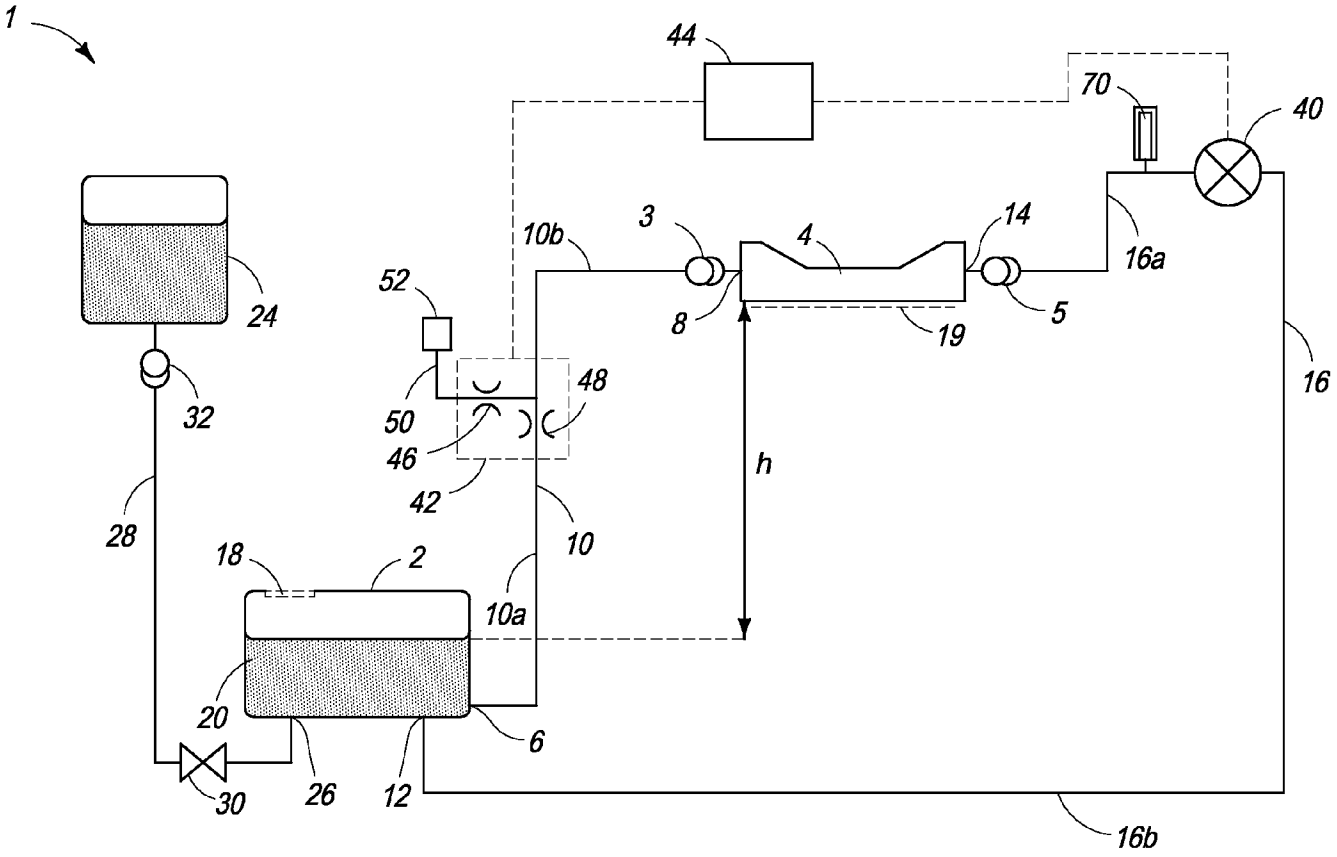
FIG. 1 is a schematic view an inkjet printer according to the present invention.

Referring to FIG. 1, there is shown schematically a printer 1 having an ink delivery system for supplying ink to a printhead. The ink delivery system is similar in function to those described in US2011/0279566 and US2011/0279562, the contents of which are herein incorporated by reference.

The printer 1 comprises an ink container 2 having a supply port 6 connected to a first port 8 of a printhead 4 via a first ink conduit 10. A return port 12 of the ink container 2 is connected to a second port 14 of the printhead 4 via a second ink conduit 16. Hence, the ink container 2, the first ink conduit 10, the printhead 4 and the second ink conduit 16 define a closed fluidic loop. Typically, the first ink conduit 10 and second ink conduit 16 are comprised of lengths of flexible tubing.

The printhead 4 is user-replaceable by means of a first coupling 3 releasably interconnecting the first port 8 and the first ink conduit 10; and a second coupling 5 releasably interconnecting the second port 14 and the second ink conduit 16. A more detailed description of the printhead 4 and its associated couplings can be found in, for example, US2011/0279566.

The ink container 2 is open to atmosphere via an air vent 18 in the form of an air-permeable membrane positioned in a roof of the ink container. Accordingly, during normal printing, ink is supplied to the printhead 4 at a negative hydrostatic pressure ("backpressure") under gravity. In other words, gravity-feeding of ink from the ink container 2 positioned below the printhead 4 provides a pressure-regulating system configured to supply ink at a negative hydrostatic pressure. The amount of backpressure experienced at the nozzle plate 19 of the printhead 4 is determined by the height h of the nozzle plate above the level of ink 20 in the ink container 2.

The pressure-regulating system typically further comprises some means for maintaining a substantially constant level of ink in the ink container 2 and, therefore, a constant height h and corresponding backpressure. As shown in FIG. 1, the pressure-regulating system comprises a bulk ink reservoir 24 connected to an inlet port 26 of the ink container 2 via a supply conduit 28 having a pressure-regulating valve 30. In some embodiments, the inlet port 26 and the return port 12 may be the same port of the ink container 2, with the second ink conduit 16 and the supply conduit 28 joined together.

The pressure-regulating valve 30 controls a flow of ink from the ink reservoir 24 into the ink container 2 so as to maintain a substantially constant level of ink in the ink container. As described in US2011/0279566, the valve 30 may be mechanically controlled by means of a float mechanism inside the ink container 2. However, it will be appreciated that other forms of valve control may be employed, such as an ink level sensor monitoring a level of ink in the ink container 2 in combination with a controller for electronically controlling operation of the valve 30 based on feedback from the ink level sensor.

The ink reservoir 24 is typically a user-replaceable ink cartridge connected to the supply conduit 28 via a supply coupling 32. Alternatively, and as described in US2011/0279562, the ink container 2 may be a user-replaceable cartridge with the ink reservoir 24, supply conduit and 28 and regulator valve 30 absent. When the ink container 2 is a user-replaceable cartridge, the height h may be maintained substantially constant by virtue of a slim or flattened height profile of the ink cartridge. A flattened height profile of the ink container 2 ensures minimal variations in the height h between full and near-empty ink cartridges.

The closed fluidic loop, incorporating the ink container 2, the first ink conduit 10, the printhead 4 and the second ink conduit 16, facilitates priming, de-priming and other printhead maintenance operations. The second ink conduit 16 includes a reversible peristaltic pump 40 for circulating ink around the fluidic loop. Thus, the second ink conduit 16 has a first section 16*a* defined between the second port 14 and the pump 40, and a second section 16*b* defined between the return port 12 and the pump 40. By way of convention only, the "forward" direction of the pump 40 corresponds to pumping ink from the supply port 6 to the return port 12 (i.e. clockwise as shown in FIG. 1), and the "reverse" direction of the pump corresponds to pumping ink from the return port 12 to the supply port 6 (i.e. anticlockwise as shown in FIG. 1).

The pump 40 cooperates with a pinch valve arrangement 42 to coordinate various fluidic operations. The pinch valve arrangement 42 comprises a first pinch valve 46 and a second pinch valve 48, and may take the form of any of the pinch valve arrangements described in, for example, US 2011/0279566; US 2011/0279562; and U.S. Ser. No. 61/752,873, the contents of which are incorporated herein by reference.

The first pinch valve 46 controls a flow of air through an air conduit 50, which is branched from the first ink conduit 10. The air conduit 50 terminates at an air filter 52, which is open to atmosphere and functions as an air intake for the closed fluidic loop. The first pinch valve 46 is positioned below a height of the nozzle plate in order to minimize ink drooling from printhead nozzles when the first pinch valve 46 is open.

By virtue of the air conduit 50, the first ink conduit 10 is divided into a third section 10*a* between the supply port 6 and the air conduit 50, and a fourth section 10*b* between the first port 8 and the air conduit 50. The second pinch valve 48 controls a flow of ink through the third section 10*a* of the first ink conduit 10.

The pump 40, the first pinch valve 46 and the second pinch valve 48 are controlled by a controller 44, which coordinates various fluidic operations. From the foregoing, it will be appreciated that the ink delivery system shown in FIG. 1 provides a versatile range of fluidic operations. Table 1 describes various pinch valve and pump states for some example fluidic operations used in the printer 1. Of course, various combinations of these example fluidic operations may be employed.

TABLE 1

Example Fluidic Operations

| Fluidic Operation | Second Pinch Valve 48 | First Pinch Valve 46 | Pump 40 |
|---|---|---|---|
| PRINT | open | closed | off |
| PRIME | open | closed | forward |
| STANDBY | open | closed | off |
| PULSE | closed | closed | reverse |
| DEPRIME | closed | open | forward |
| NULL | closed | closed | off |

During normal printing ("PRINT" mode), the printhead 4 draws ink from the ink container 2 at a negative backpressure under gravity. In this mode, the peristaltic pump 40 functions as a shut-off valve, whilst the first pinch valve 46 is closed and the second pinch valve 48 is open to allow ink flow from the supply port 6 to the first port 8 of the printhead 4.

During printhead priming or flushing ("PRIME" mode), ink is circulated around the closed fluidic loop in the forward direction (i.e. clockwise as shown in FIG. 1). In this mode, the peristaltic pump 40 is actuated in the forward pumping direction whilst the first pinch valve 46 is closed and the second pinch valve 48 is open to allow ink flow from the supply port to the return port 12 via the printhead 4. Priming in this manner may be used to prime a deprimed printhead with ink or to flush air bubbles from the system. Flushed air bubbles are returned to the ink container 2 where they can be vented to atmosphere via the air vent 18.

In the "STANDBY" mode, the pump 40 is switched off whilst the first pinch valve 46 is closed and the second pinch valve 48 is open. The "STANDBY" mode maintains a negative hydrostatic ink pressure at the printhead 4, which minimizes color mixing on the nozzle plate 19 when the printer is idle. Usually, the printhead is capped in this mode to minimize evaporation of ink from the nozzles (see, for example, US2011/0279519, the contents of which are herein incorporated by reference).

In order to ensure each nozzle of printhead 4 is fully primed with ink and/or to unblock any nozzles which have become clogged, a "PULSE" mode may be employed. In the "PULSE" mode, the first and second pinch valves 46 and 48 are closed, while the pump 40 is actuated in a reverse direction (i.e. anticlockwise as shown in FIG. 1) to force ink through nozzles defined in the nozzle plate 19 of the printhead 4.

In order to replace a spent printhead 4, it is necessary to de-prime the printhead before it can be removed from the printer. In the "DEPRIME" mode, the first pinch valve 46 is open, the second pinch valve 48 is closed and the pump 40 is actuated in the forward direction to draw in air from atmosphere via the air conduit 50. Once the printhead 4 has been deprimed of ink, the printer is set to "NULL" mode, which isolates the printhead from the ink supply, thereby allowing safe removal of the printhead with minimal ink spillages.

When the printer 1 is switched on or when the printer wakes up from an idle period (e.g. by being sent a new print job), the ink delivery system must ensure the printhead 4 is in a state ready for printing. Typically, this will involve a prime and/or a pulse operation, usually in combination with various other maintenance operations (e.g. wiping, spitting etc) depending, for example, on the period of time since the last print job. The printer may be set to "PRIME" mode relatively frequently in order to circulate ink around the closed fluidic loop.

The peristaltic pump 40 is a key component of the ink delivery system. Peristaltic pumps are well known in the art and typically employ a plurality of lobes which cyclically compress flexible tubing to effect a peristaltic pumping action. Peristaltic pumps advantageously do not contaminate pumped fluids making them ideal for use in ink delivery systems.

A characteristic of peristaltic pumps and, indeed, most pumps, is that an oscillating pressure is imparted to the pumped fluid. These oscillating pressure fluctuations in the fluid correspond with the compression and resilient expansion of the flexible tubing as the pump lobes cyclically act on the tubing. In the context of ink delivery systems for inkjet printheads, an ink pressure which oscillates between peak and low pressures during pumping can be problematic. If the highest pressure in the ink exceeds a predetermined value, then this may cause the printhead to flood. On the other hand, if the lowest pressure in the ink is lower than a predetermined value, then this may cause the printhead to "gulp" and draw in air through the nozzles. Both flooding and gulping are undesirable, since they ultimately lead to a deterioration of print quality.

Referring again to FIG. 1, an air compliance chamber 70 is positioned between the printhead 4 and the pump 40 in fluid communication with the second ink conduit 16. The air compliance chamber 70 comprises an air-filled chamber, which dampens ink pressure fluctuations in the ink delivery system by compression of air. By positioning the air compliance chamber 70 close to printhead 4 (e.g. less than 100 mm from the printhead, less than 75 mm from the printhead, or between 30 and 60 mm from the printhead), the chamber has maximum effect in dampening ink pressure fluctuations experienced at the printhead nozzles, and therefore suppresses any undesirable flooding or gulping. Furthermore, the air compliance chamber 70 is positioned higher than the printhead 4 so as to function as a bubble-trap for any air bubbles in the ink delivery system, which have a natural buoyancy and tend to rise towards the highest point in the system.

Figure 2:
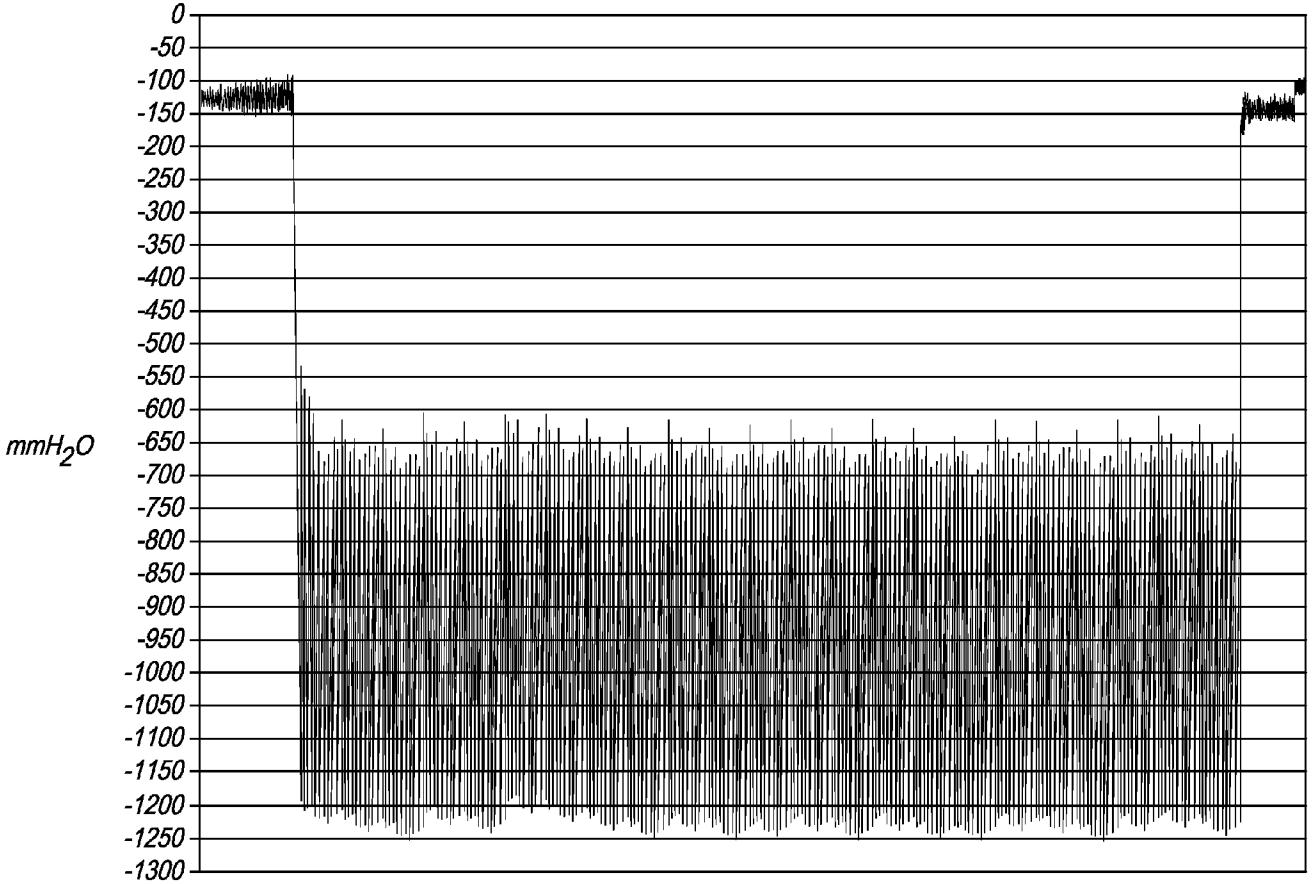
FIG. 2 is a pressure trace of an un-dampened ink delivery system.
Figure 3:
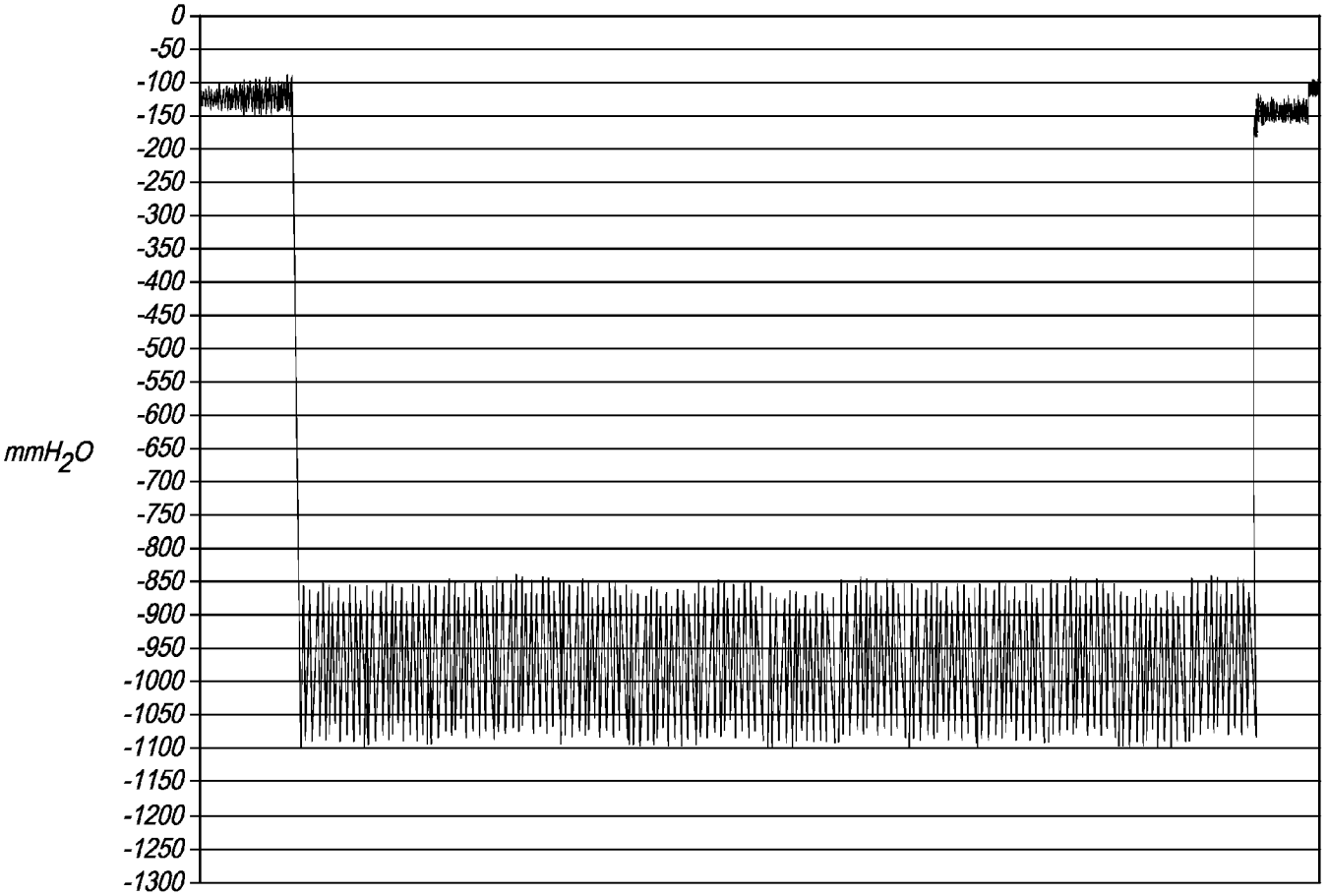
FIG. 3 is a pressure trace of a dampened ink delivery system according to the present invention.

FIGS. 2 and 3 show real-time ink pressure traces for un-dampened and dampened ink delivery systems. In FIG. 2, the ink delivery system is as shown in FIG. 1 but with the air compliance chamber 70 absent. For this un-dampened system, the average pressure during pumping is stable at about −975 $mmH_2O$, but the dynamic pressure oscillates between about −600 and −1250 $mmH_2O$. In this example, the lowest pressure of about −1250 $mmH_2O$ is close to the gulping point of the printhead 4 and represents a significant risk of gulping during pumping.

In FIG. 3, the ink delivery is as shown in FIG. 1, including the air compliance chamber 70 having a volume of about 0.4 mL. From FIG. 3, it will be seen that the air compliance chamber 70 functions as a 'shock absorber' in the ink delivery system. For this dampened system, the average pressure during pumping is still stable at about −975 $mmH_2O$, but the dynamic pressure oscillations are significantly reduced and vary between about −850 and −975 $mmH_2O$. Hence, the lowest pressure of −975 $mmH_2O$ is much further from the gulping point of the printhead 4, which minimizes the risk of undesirable gulping during pumping.

Figure 4:
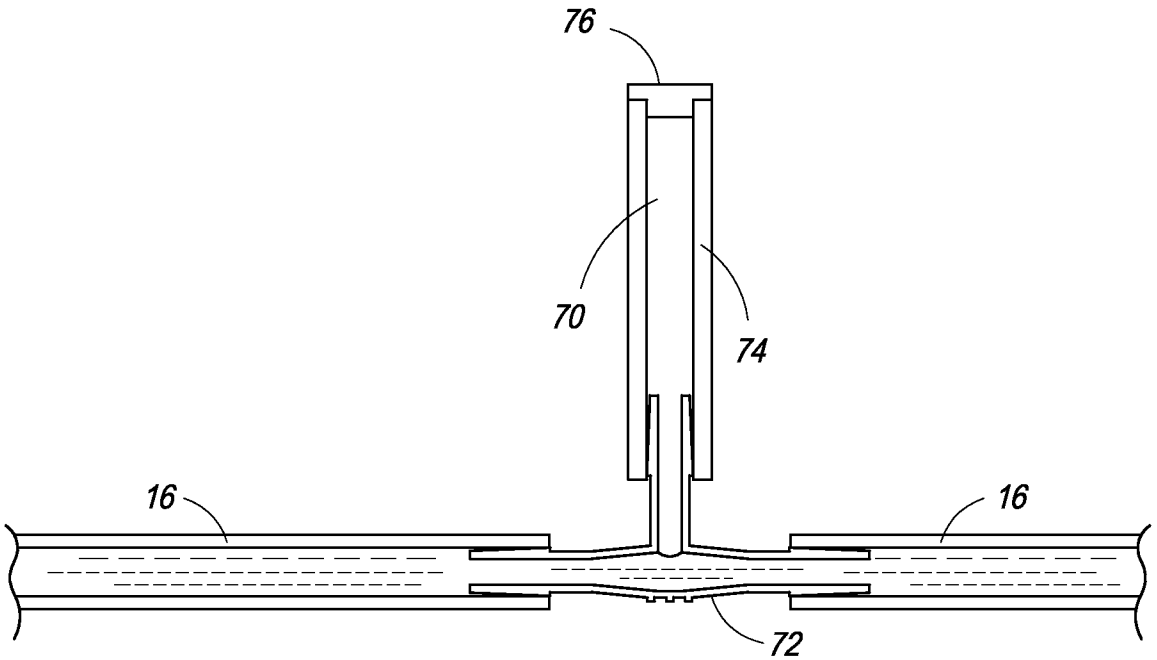
FIG. 4 shows a self-recovering air compliance chamber.

Referring to FIG. 4, the air compliance chamber 70 may be connected to the second ink conduit 16 via a simple T-connector 72 or similar. The chamber 70 comprises sidewalls 74 defined by a length of tubing and a cap 76. The tubing defining the sidewalls 74 of the chamber 70 may be comprised of Tygoprene® XL-60 having an internal diameter of 3.6 mm. The length of tubing may be adjusted to provide optimal dampening. In this example, the tubing has a length about 4 cm to provide a chamber volume of about 0.4 mL.

A significant problem with air compliance chambers is that they are ineffective if they become filled with ink. The chamber sidewalls 74 may be configured to extend generally upwards to minimize the risk of ink filling the chamber 70 when the printer is tilted. However, over the lifetime of the printer, there is a significant problem of the air compliance chamber 70 becoming ineffective or only partially effective due to ingress of ink.

Figure 5:
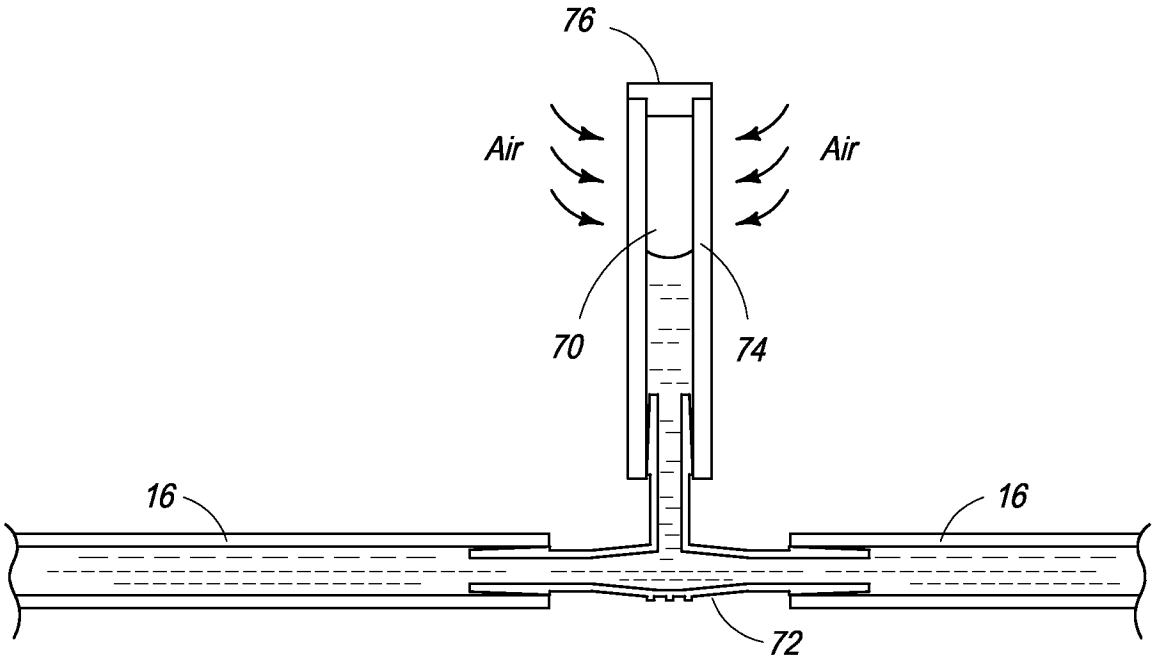
FIG. 5 shows the air compliance chamber of FIG. 4 during recovery.

Referring to FIG. 5, there is shown the air compliance chamber 70, which has been partially filled with ink. The efficacy of this partially-filled chamber is reduced, because the volume of compressible air inside the chamber has been reduced.

As shown in FIG. 5, the printer is in its "STANDBY" mode with a negative hydrostatic ink pressure by virtue of fluidic communication between the chamber 70 and the ink container 2. Since the sidewalls 74 of the chamber 70 have a degree of air-permeability, the chamber is self-recovering, because air from atmosphere is allowed to enter the chamber by diffusing through the sidewalls. By virtue of the negative ink pressure, air entering the chamber 70 via the sidewalls 74 can displace any ink in the chamber and eventually restore the chamber to its optimum operational state, as shown in FIG. 4. Typically, the air compliance chamber 70 is restored to its optimum operational state within a few days (e.g. 1 to 7 days) of becoming fouled with ink. Of course, trapping air bubbles in the air compliance chamber 70 also aids recovery.

For the sake of clarity, the present invention has been described in connection with a single ink channel. However, it will of course be appreciated that the present invention may be employed with multiple ink channels. For example, the printhead 4 may comprises N ink channels (e.g. CMYK, CMYKK, CMY etc) supplied with ink from N ink containers 2, with each of the N ink containers 2 connected to the printhead via respective first and second ink conduits 10 and 16. (Typically, N is an integer from 2 to 10). Each second conduit 16 will typically have a respective air compliance chamber 70 in fluid communication therewith. In the case of multiple ink channels, the printer 1 typically employs shared components in the ink delivery system, such as a multiple channel peristaltic pump 40, a multiple channel pinch valve arrangement 42 and multiple channel printhead couplings 3 and 5.

It will, of course, be appreciated that the present invention has been described by way of example only and that modifications of detail may be made within the scope of the invention, which is defined in the accompanying claims.

The invention claimed is:

1. An inkjet printer comprising:

an inkjet printhead;

an ink delivery system connected to the printhead and configured for supplying ink to the printhead at a negative hydrostatic pressure, the ink delivery system comprising an ink conduit; and an air chamber comprising polymer tubing having one end connected to the ink conduit and an opposite end capped, the polymer tubing extending generally upwards from the ink conduit and defining sidewalls of the air chamber, wherein the polymer tubing is air-permeable and has an exterior surface exposed to atmosphere.

2. The inkjet printer of claim 1, wherein the polymer tubing has an oxygen permeability of less than 100 Barrer ($334.8\times10^{-19}$ kmol m/(m2 s Pa)).

3. The inkjet printer of claim 1, wherein the polymer tubing has an oxygen permeability in the range of 5 to 50 Barrer (16.74 to 167.4×10−19 kmol m/(m2 s Pa)).

4. The inkjet printer of claim 1, wherein the air chamber is positioned at a height above the printhead.

5. The inkjet printer of claim 1, further comprising wherein the ink delivery system comprises a pressure-regulating system for controlling the hydrostatic pressure in the ink delivery system.

6. The inkjet printer of claim 1, wherein the ink delivery system comprises a pump.

7. The inkjet printer of claim 6, wherein the air chamber is connected to an ink conduit interconnecting the printhead and the pump.

8. The inkjet printer of claim 1, wherein the ink delivery system comprises:

an ink container positioned below a height of the printhead, the ink container comprising an air vent open to atmosphere and a supply port;

a first conduit interconnecting the supply port and a first port of the printhead, wherein ink is gravity-fed to the printhead at negative hydrostatic pressure.

9. The inkjet printer of claim 8, further comprising:

a valve for controlling a flow of ink in the first conduit; and a controller for controlling opening and closing of the valve, wherein the controller is configured to open the valve when the printer is idle, such that the ink delivery system is at a negative hydrostatic pressure during idle periods, thereby allowing recovery of the air chamber via diffusion of air through the air-permeable wall.

10. The inkjet printer of claim 8, wherein the ink delivery system further comprises:

a second ink conduit interconnecting a second port of the printhead and a return port of the ink container; and a pump positioned in the second ink conduit.

11. The inkjet printer of claim 10, wherein the air chamber is connected to the second ink conduit between the pump and the printhead.

12. The inkjet printer of claim 10, wherein the pump is a reversible peristaltic pump.

13. The inkjet printer of claim 8, further comprising an ink reservoir in fluid communication with the ink container.

14. The inkjet printer of claim 13, further comprising a regulator valve for controlling a flow of ink into the ink container from the ink reservoir, and thereby maintaining a constant level of ink in the ink container.

* * * * *